US006018831A

United States Patent [19]

Loomos

[11] Patent Number: 6,018,831

[45] Date of Patent: Feb. 1, 2000

[54] PILLOW WITH CANTILEVER SUPPORTS

[76] Inventor: Melanie D. Loomos, 1925 Brickell Ave., Miami, Fla. 33131

[21] Appl. No.: 09/251,626

[22] Filed: Feb. 17, 1999

[51] Int. Cl.[7] ..... A47G 9/00

[52] U.S. Cl. ..... 5/636; 5/490

[58] Field of Search ..... 5/636, 639, 640, 5/643, 490

[56] References Cited

U.S. PATENT DOCUMENTS

| | | | |
|---|---|---|---|
| 1,742,186 | 1/1930 | Claus . | |
| 4,132,228 | 1/1979 | Green | 128/33 |
| 4,709,431 | 12/1987 | Shaktman | 5/481 |
| 4,824,174 | 4/1989 | Dunn, Sr. | 297/453 |
| 5,288,132 | 2/1994 | Vaughn | 297/452.22 |
| 5,702,153 | 12/1997 | Pliska | 297/256.16 |

*Primary Examiner*—Alexander Grosz
*Attorney, Agent, or Firm*—Joseph N. Breaux

[57] ABSTRACT

A pillow with cantilever supports for supplying comfortable support for a body part without supplying an undesirable pain generating force against a tender or pain prone body portion located adjacent to the supported body part. The pillow includes a pillow assembly that is positioned within a removable outer cover member. The pillow assembly including middle firmness density foam lower pillow layer member, two identical spaced, firmest density foam center pillow layer members, and two identical spaced, firmest density foam center pillow layer members. The outer cover member surrounds the pillow assembly and includes a pillow assembly insertion opening sealable with a flap.

1 Claim, 1 Drawing Sheet

PILLOW WITH CANTILEVER SUPPORTS

TECHNICAL FIELD

The present invention relates to cushions and pillows and more particularly to a pillow with cantilever supports that includes a pillow assembly that is positioned within a removable outer cover member; the pillow assembly including middle firmness density foam lower pillow layer member, two identical spaced, firmest density foam center pillow layer members, and two identical spaced, firmest density foam center pillow layer members; each of the two identical spaced, firmest density foam center pillow layer members being bonded to the lower pillow layer member; each center pillow layer member having a curved center member inner facing side that is spaced apart from the other curved center member inner facing side to form a center member gap; each of the two identical spaced, lowest firmness density foam upper pillow layer members being bonded to one of the two identical spaced, firmest density foam center pillow layer members; each upper pillow layer member having a curved upper member inner facing side that is spaced apart from the other curved upper member inner facing side to form an upper member gap; the upper member gap being smaller than the center member gap by a distance of at least two inches such that each curved upper member inner facing side extends past its respective curved center member inner facing side by a minimum of one inch; the outer cover member surrounding the pillow assembly and including a pillow assembly insertion opening sealable with a flap having a hook and pile fastener through which the pillow assembly is inserted and removed from the outer cover member and a center expansion slit formed through the center of the outer cover member upper surface and positioned over the upper member gap when the pillow assembly is positioned within the outer cover member.

BACKGROUND ART

It is often desirable to have a pillow for supporting one portion of the body, such as the buttocks, without placing an undesirable force on an adjacent portion of the body. It would be a benefit, therefore to have a pillow that supplied a comfortable support for a body part without supplying an undesirable pain generating force against a tender or pain prone body portion located adjacent to the supported body part.

GENERAL SUMMARY DISCUSSION OF INVENTION

It is thus an object of the invention to provide a pillow that includes cantilever supports for supplying comfortable support for a body part without supplying an undesirable pain generating force against a tender or pain prone body portion located adjacent to the supported body part.

It is a further object of the invention to provide a pillow with cantilever supports that includes a pillow assembly that is positioned within a removable outer cover member; the pillow assembly including middle firmness density foam lower pillow layer member, two identical spaced, firmest density foam center pillow layer members, and two identical spaced, firmest density foam center pillow layer members; each of the two identical spaced, firmest density foam center pillow layer members being bonded to the lower pillow layer member; each center pillow layer member having a curved center member inner facing side that is spaced apart from the other curved center member inner facing side to form a center member gap; each of the two identical spaced, lowest firmness density foam upper pillow layer members being bonded to one of the two identical spaced, firmest density foam center pillow layer members; each upper pillow layer member having a curved upper member inner facing side that is spaced apart from the other curved upper member inner facing side to form an upper member gap; the upper member gap being smaller than the center member gap by a distance of at least two inches such that each curved upper member inner facing side extends past its respective curved center member inner facing side by a minimum of one inch; the outer cover member surrounding the pillow assembly and including a pillow assembly insertion opening sealable with a flap having a hook and pile fastener through which the pillow assembly is inserted and removed from the outer cover member and a center expansion slit formed through the center of the outer cover member upper surface and positioned over the upper member gap when the pillow assembly is positioned within the outer cover member.

It is a still further object of the invention to provide a pillow with cantilever supports that accomplishes all or some of the above objects in combination.

Accordingly, a pillow with cantilever supports is provided. The pillow with cantilever supports includes a pillow assembly that is positioned within a removable outer cover member; the pillow assembly including middle firmness density foam lower pillow layer member, two identical spaced, firmest density foam center pillow layer members, and two identical spaced, firmest density foam center pillow layer members; each of the two identical spaced, firmest density foam center pillow layer members being bonded to the lower pillow layer member; each center pillow layer member having a curved center member inner facing side that is spaced apart from the other curved center member inner facing side to form a center member gap; each of the two identical spaced, lowest firmness density foam upper pillow layer members being bonded to one of the two identical spaced, firmest density foam center pillow layer members; each upper pillow layer member having a curved upper member inner facing side that is spaced apart from the other curved upper member inner facing side to form an upper member gap; the upper member gap being smaller than the center member gap by a distance of at least two inches such that each curved upper member inner facing side extends past its respective curved center member inner facing side by a minimum of one inch; the outer cover member surrounding the pillow assembly and including a pillow assembly insertion opening sealable with a flap having a hook and pile fastener through which the pillow assembly is inserted and removed from the outer cover member and a center expansion slit formed through the center of the outer cover member upper surface and positioned over the upper member gap when the pillow assembly is positioned within the outer cover member.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
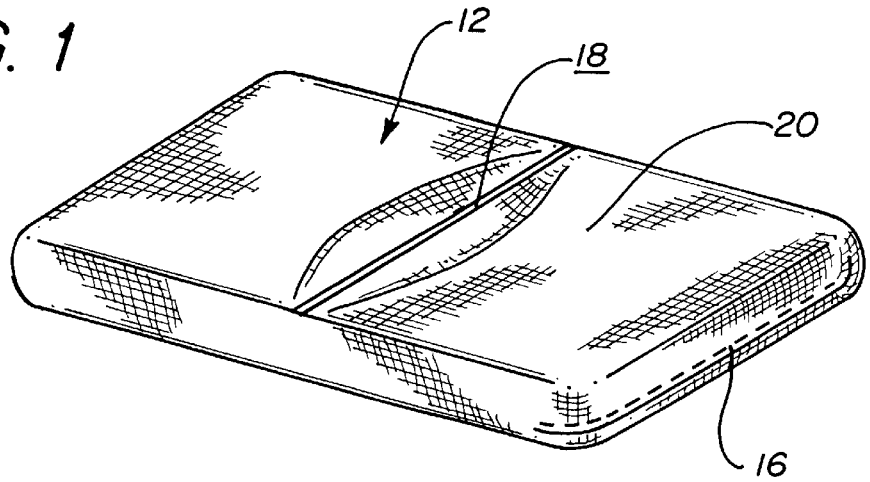
FIG. 1 is a perspective view of an exemplary embodiment of the pillow with cantilever supports of the present invention showing the outer cover member surrounding the pillow assembly and including a pillow assembly insertion opening sealable with a flap having a hook and pile fastener and a center expansion slit formed through the center of the outer cover member upper surface.
Figure 2:
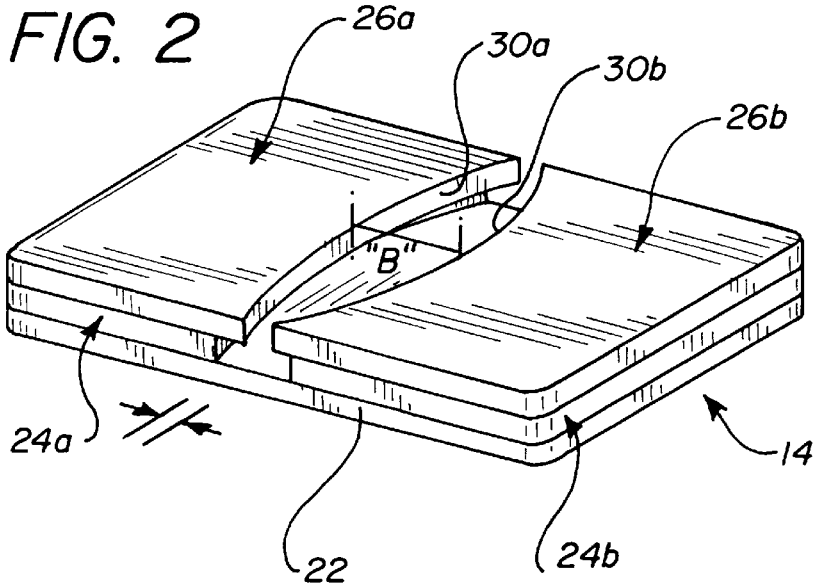
FIG. 2 is a perspective view of the pillow assembly of the pillow with cantilever supports of FIG. 1 in isolation showing the middle firmness density foam lower pillow layer member; the two identical spaced, firmest density foam center pillow layer members bonded to lower pillow layer member, each having a curved center member inner facing side that is spaced apart from the other curved center member inner facing side to form a center member gap; and the two identical spaced, lowest firmness density foam upper pillow layer member each bonded to one of the two identical spaced, firmest density foam center pillow layer members, each upper pillow layer member having a curved upper member inner facing side that is spaced apart from the other curved upper member inner facing side to form an upper member gap; the upper member gap being smaller than the center member gap by a distance of at least two inches such that each curved upper member inner facing side extends past its respective curved center member inner facing side by a minimum of one inch.

FIG. 1 shows an exemplary embodiment of the pillow with cantilever supports of the present invention, generally designated 10. Pillow 10 includes a fabric outer cover member, generally designated 12, enclosing a pillow assembly, generally designated 14 (FIG. 2). Outer cover member 12 is of conventional stitched fabric construction and includes a pillow assembly insertion opening that is sealable with a flap 16 having a hook and pile fastener and a center expansion slit 18 formed through the center of the outer cover member outer surface 20.

Referring now to FIG. 2, pillow assembly 14 includes a middle firmness density foam lower pillow layer member, generally designated 22; two identical spaced, firmest density foam center pillow layer members, generally designated 24*a*,24*b*, bonded to lower pillow layer member 22; and two identical spaced, lowest firmness density foam upper pillow layer members, generally designated 26*a*,26*b*, each bonded to one of the two identical spaced, firmest density foam center pillow layer members 24*a*,24*b* respectively.

Figure 3:
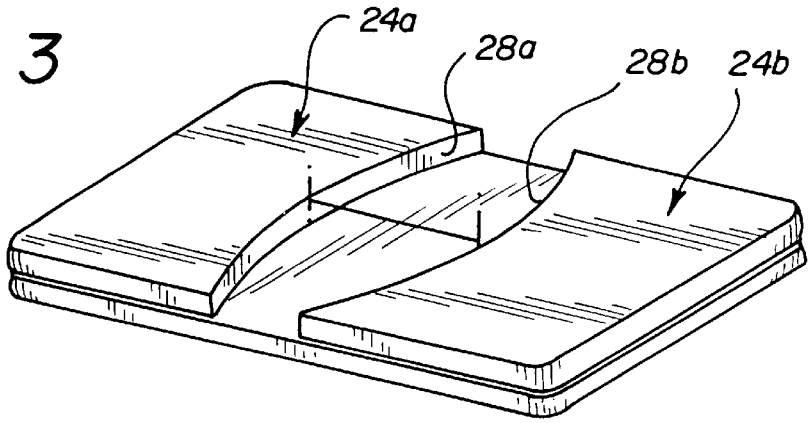
FIG. 3 is a perspective view of the pillow assembly of FIG. 2 with the two identical spaced, lowest firmness density foam upper pillow layer members removed to show the center member gap between the curved center member inner facing sides of the two identical spaced, firmest density foam center pillow layer members.

Referring to FIG. 3, each firmest density foam center pillow layer member 24*a*,24*b* has a curved center member inner facing side 28*a*,28*b* that is spaced apart from the other curved center member inner facing side 28*a*,28*b* to form a center member gap "A" of five inches. With reference back to FIG. 2, each upper pillow layer member 26*a*,26*b* has a curved upper member inner facing side 30*a*,30*b* that is spaced apart from the other curved upper member inner facing side 30*a*,30*b* to form an upper member gap "B" of one inch.

With general reference to FIGS. 1–3, in use, pillow assembly 14 is inserted into outer cover member 12 after each laundering or cleaning such that upper member gap "B" is positioned directly under center expansion slit 18. Center expansion slit 18 allows the edges of upper pillow layer member 26*a*,26*b* that cantilever past the curved edges 28*a*,28*b* of center pillow layer members 24*a*,24*b* to flex easily and prevent an uncomfortable force from being applied to the body portion positioned above the upper member gap "B".

It can be seen from the preceding description that a pillow with cantilever supports has been provided that includes cantilever supports for supplying comfortable support for a body part without supplying an undesirable pain generating force against a tender or pain prone body portion located adjacent to the supported body part; and that includes a pillow assembly that is positioned within a removable outer cover member; the pillow assembly including middle firmness density foam lower pillow layer member, two identical spaced, firmest density foam center pillow layer members, and two identical spaced, firmest density foam center pillow layer members; each of the two identical spaced, firmest density foam center pillow layer members being bonded to the lower pillow layer member; each center pillow layer member having a curved center member inner facing side that is spaced apart from the other curved center member inner facing side to form a center member gap; each of the two identical spaced, lowest firmness density foam upper pillow layer members being bonded to one of the two identical spaced, firmest density foam center pillow layer members; each upper pillow layer member having a curved upper member inner facing side that is spaced apart from the other curved upper member inner facing side to form an upper member gap; the upper member gap being smaller than the center member gap by a distance of at least two inches such that each curved upper member inner facing side extends past its respective curved center member inner facing side by a minimum of one inch; the outer cover member surrounding the pillow assembly and including a pillow assembly insertion opening sealable with a flap having a hook and pile fastener through which the pillow assembly is inserted and removed from the outer cover member and a center expansion slit formed through the center of the outer cover member upper surface and positioned over the upper member gap when the pillow assembly is positioned within the outer cover member.

It is noted that the embodiment of the pillow with cantilever supports described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A pillow with cantilever supports comprising:

an outer cover member (12); and a pillow assembly (14) including a middle firmness density foam lower pillow layer member (22), two identical spaced, firmest density foam center pillow layer members (24*a*,24*b*), and two identical spaced, lowest firmness density foam upper pillow layer members (26*a*,26*b*);

each of said two identical spaced, firmest density foam center pillow layer members (24*a*,24*b*) being bonded to said lower pillow layer member (22);

each of said two identical spaced, firmest density foam center pillow layer members (24*a*,24*b*) having a curved center member inner facing side (28*a*,28*b*) that is spaced apart from said other curved center member inner facing side (28*a*,28*b*) to form a center member gap (A);

each of said two identical spaced, lowest firmness density foam upper pillow layer members (26*a*,26*b*) being bonded to one of said two identical spaced, firmest density foam center pillow layer members (24*a*,24*b*);

each of said two identical spaced, lowest firmness density foam upper pillow layer members (26*a*,26*b*) having a curved upper member inner facing side (30*a*,30*b*) that is spaced apart from said other curved upper member inner facing side (30*a*,30*b*) to form an upper member gap (B);

said upper member gap (B) being smaller than said center member gap (A) by a distance of at least two inches such that each curved upper member inner facing side (30*a*,30*b*) extends past its respective curved center member inner facing side (28*a*,28*b*) by a minimum of one inch;

said outer cover member (12) surrounding said pillow assembly (14) and including a pillow assembly insertion opening sealable with a flap (16) having a hook and pile fastener through which said pillow assembly (14) is inserted and removed from said outer cover member (12) and a center expansion slit (18) formed through a center of an outer cover member upper surface (20) and positioned over said upper member gap (B) when said pillow assembly (14) is positioned within said outer cover member (12).

* * * * *